US005079080A

United States Patent [19]

Schwarz

[11] Patent Number: 5,079,080

[45] Date of Patent: Jan. 7, 1992

[54] PROCESS FOR FORMING A SUPERABSORBENT COMPOSITE WEB FROM FIBERFORMING THERMOPLASTIC POLYMER AND SUPERSORBING POLYMER AND PRODUCTS PRODUCED THEREBY

[75] Inventor: Eckhard C. A. Schwarz, Neenah, Wis.

[73] Assignee: Bix Fiberfilm Corporation, Neenah, Wis.

[21] Appl. No.: 358,242

[22] Filed: May 26, 1989

[51] Int. Cl.[5] ..... B32B 5/08; B32B 27/02; D04H 1/56; D04H 3/16

[52] U.S. Cl. ..... 428/288; 156/62.4; 428/296; 428/297; 428/303

[58] Field of Search ..... 428/296, 297, 303, 288

[56] References Cited

U.S. PATENT DOCUMENTS

| | | | |
|---|---|---|---|
| 4,380,570 | 4/1983 | Schwarz | 428/296 |
| 4,741,949 | 5/1988 | Morman et al. | 428/288 |
| 4,803,117 | 2/1989 | Daponte | 428/288 |
| 4,820,577 | 4/1989 | Morman et al. | 428/297 |
| 4,828,911 | 5/1989 | Morman | 428/296 |
| 4,847,141 | 7/1989 | Pazos et al. | 428/296 |
| 4,923,742 | 5/1990 | Killian et al. | 428/288 |

*Primary Examiner*—James C. Cannon
*Attorney, Agent, or Firm*—Louis E. Marn

[57] ABSTRACT

There is disclosed a novel process to form a water-absorbing sheet by extruding an aqueous solution of superabsorbing polymer as a fibrous stream onto a high velocity, hot fibrous stream of melt-blown fibers of thermoplastic polymer, causing entanglement of the fiber and forming a superabsorbent non-woven mat free of dusting problems.

10 Claims, 3 Drawing Sheets

PROCESS FOR FORMING A SUPERABSORBENT COMPOSITE WEB FROM FIBERFORMING THERMOPLASTIC POLYMER AND SUPERSORBING POLYMER AND PRODUCTS PRODUCED THEREBY

BACKGROUND OF THE INVENTION (1) Field of the Invention

This invention relates to a process for melt-blowing a composite web, and more particularly to a process for melt-blowing superabsorbent fibrous composite webs and the product produced thereby.

(2) Description of the Prior Art

To increase the sorbency of fibrous webs by addition of superabsorbent particles has been the object of several prior workers. U.S. Pat. No. 4,429,001 describes the prior art of this approach, where superabsorbent particles are entrapped in a web of fine fibers. The disadvantage of this method is that the particles are either too well entrapped and shielded from the liquid to be sorbed, and therefor the absorbency is limited, or bonding of the particles is incomplete and the particles, prior to use, are "dusting out".

OBJECTS OF THE INVENTION

An object of the present invention is to provide a process for forming a superabsorbent fibrous composite web using melt-blowing techniques.

Another object of the present invention is to provide a novel apparatus and process to intermingle melt-blown thermoplastic fibers with fibers made from superabsorbent polymers.

Still another object of this invention is to provide a composite web of improved absorbency and physical strength in the dry and wet state, with an absence of "dusting out" of superabsorbent particles.

SUMMARY OF THE INVENTION

These and other objects of the present invention are achieved by pumping an aqueous solution of uncatalyzed superabsorbent polymer at room temperature to a melt-blowing die. A cross-linking catalyst is mixed to the solution shortly before introduction into the die. Hot air of about 280° F. is introduced into an air manifold of the die at no more than 15 psi air pressure, and the solution is spun vertically downwardly as a viscous stream of fibers surrounded by laminar air flow. At approximately 36" below the first die, the downward stream of the viscous aqueous solution of the superabsorbent fiber is impacted by a high velocity stream of melt-blown fibers at an angle of 60 to 90 degrees, coming from a melt-blowing system such as described in U.S. Pat. No. 4,380,570. Such thermoplastic fibers are at about 700° F. and are propelled by the hot air to about 500 meter per second. At the point of impact of the two fiber streams, the fibers intermingle intensely and the heat from the melt-blown fiber stream evaporates the water from the superabsorbent fibers and activates the cross-linking catalyst to make the superabsorbent fibers water-swellable, but insoluble.

DETAILED DESCRIPTION OF THE INVENTION

Figure 1:
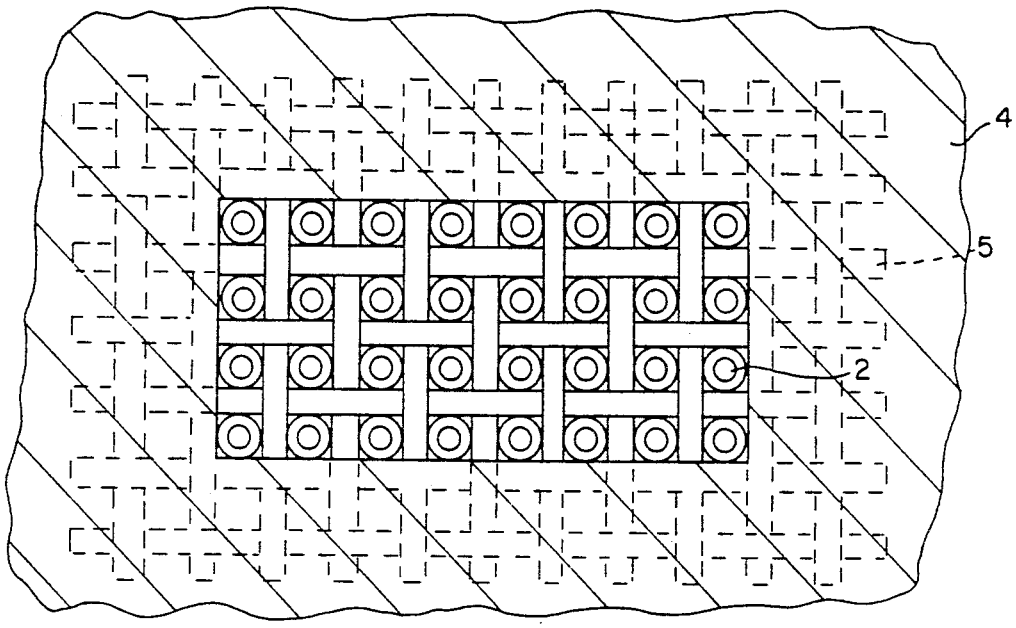
FIG. 1 is a schematic bottom view of the extrusion dies for both the superabsorbent polymer solution and the melt-blown polymer.
Figure 2:
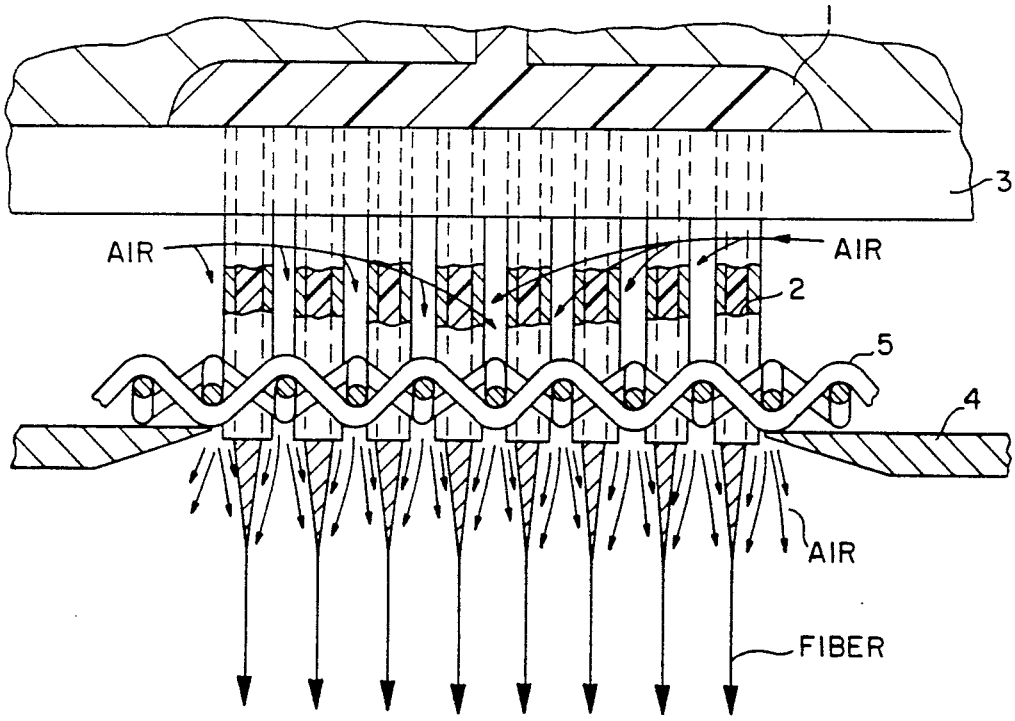
FIG. 2 is a cross-sectional side view of the extrusion dies of FIG. 1.

In FIG. 1 and 2, 1 is the resin cavity into which resin or solution is pumped, the cavity leads to the spin nozzles 2, which is held by the mounting plate 3. Hot air enters the air manifold and exits through the screen 5, held by the retainer plate 4. Air thus surrounds each nozzle, blowing fibers downwardly at a velocity controlled by the air pressure entering the air manifold.

Figure 3:
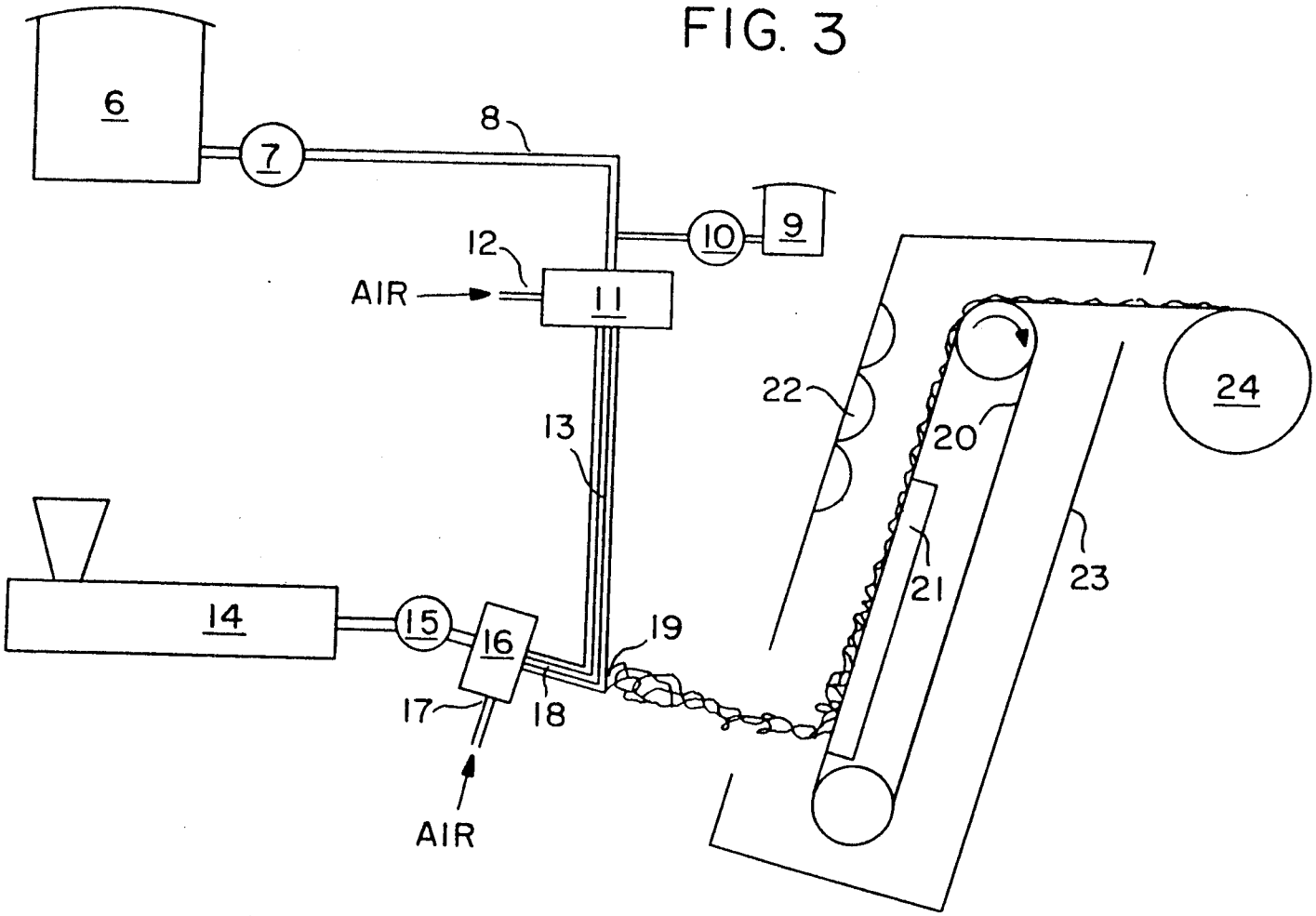
FIG. 3 is a schematic diagram of the entire process showing all its essential components.

Referring to FIG. 3, there is provided a storage tank 6 for superabsorbent polymer solution of aqueous or other suitable solvent, feeding metering pump 7 to the transfer line 8; 9 is a smaller tank feeding cross-linking catalyst through pump 10 to the transfer line 8 shortly before entering the melt-blowing die 11; hot compressed air is fed into the air manifold of die 11, and viscous aqueous fibers 13 leave the die surrounded by a laminar flow of hot air, starting the evaporation of water from the superabsorbent fiber, thus strengthening the fibers. The extrusion die design is similar to those disclosed in the U.S. Pat. No. 4,380,570 incorporated herein by reference.

14 is an extruder, melting and pumping fiber forming thermoplastic polymer to metering pump 15 into the heated melt-blowing die 16. High pressure air of about 700° F. is fed into the air manifold of die 16 and blows fibers 18 at approximately sonic velocity onto fiber stream 13; at 19 the fiber streams mix, and the heated air of die 16 assists in evaporating the water from the superabsorbent fibers 13 and propels the composite web onto the moving screen 20; 21 is a vacuum chamber removing water vapor and heated air from the web. The web is further heated by radiation heaters 22, mounted in chamber 23. The web exits chamber 23 and is wound on winder 24.

Preferably both the superabsorbent fibers and the thermoplastic fibers are essentially continuous in length.

Figure 4:
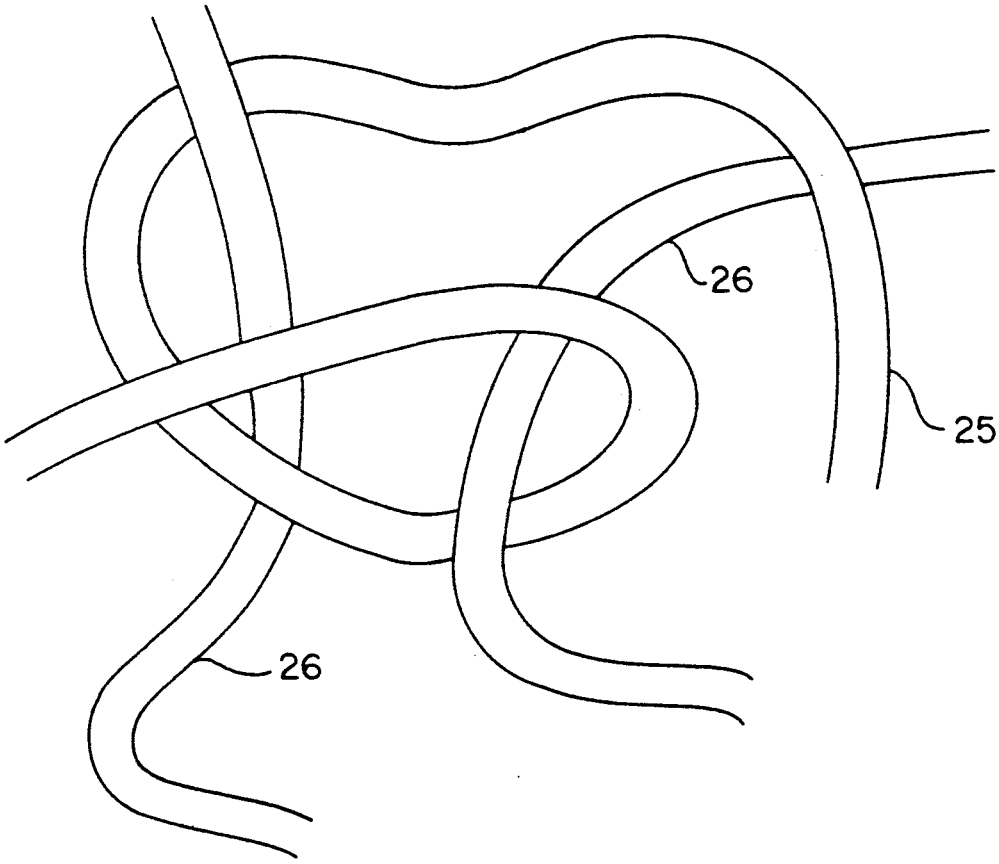
FIG. 4 is a schematic diagram of the composite web produced by the process.

FIG. 4 shows a schematic diagram of the resulting composite web. The superabsorbent fibers 25 are entangled in the thermoplastic polymer fiber matrix 26, and are well separated from each other. This results in a higher degree of absorbency and a lack of "dusting out" of the superabsorbent fibers.

EXAMPLES OF THE INVENTION

The following examples are included for the purpose of illustrating the invention and it is to be understood that the scope of the invention is not to be limited thereby.

EXAMPLE 1-8

For Examples 1 to 8, the apparatus of FIG. 3 is used. The extrusion dies 11 and 16 of FIG. 3 are shown in FIGS. 1 and 2 and have the following nozzle dimensions: Die 11 has 4 rows of nozzles, 2 cm long, spaced 0.42 cm apart from center to center, the inside diameter of the nozzles is 0.91 mm. Each row has 21 nozzles, a total of 84. Die 16 has 3 rows of nozzles 1.5 cm long, spaced 0.21 cm apart, the inside diameter of the nozzles is 0.33 mm, each row has 55 nozzles, a total of 165. Tank 6 holds a solution of high molecular weight polyacrylic acid supplied by Chemdal Corporation, 60% (percent) by weight solids in water, tank 9 is filled with a 3% (percent) emulsion of benzoyl peroxide in water. 14 is a 1" diameter, 24" long extruder equipped with 3 heating zones, feeding thermoplastic polymer through a "Zenith" gear pump to die 16. The vacuum box 21 is connected to a suction fan driven by a 2 HP motor.

Eight types of highly entangled melt-blown webs were made under conditions listed below in Table I.

TABLE I

| | 1 | 2 | 3 | 4 | 5 | 6 | 7 | 8 |
|---|---|---|---|---|---|---|---|---|
| Example Rate of Solution Flow from Tank 6 ($cm^3$/min) | 35 | 35 | 35 | 18 | 18 | 18 | 18 | 35 |
| Rate of Catalyst Flow from Tank 9 ($cm^3$/min) | 1.75 | 1.75 | 1.75 | 0.9 | 0.9 | 0.9 | 0.9 | 1.75 |
| Air pressure at 12 (psi) | 6 | 6 | 6 | 6 | 5 | 5 | 5 | 6 |
| Air temperature at 12 (°C.) | 140 | 140 | 140 | 140 | 130 | 130 | 130 | 130 |
| Fiber size 13 in Web (micrometer) | 10 | 10 | 10 | 8 | 8 | 10 | 8 | 10 |
| Polymer type in* Extruder 14 | PP | PP | PP | PP | PP | PET | PET | N-66 |
| Polymer Feed Rate at Pump 16 ($cm^3$/min) | 62 | 83 | 104 | 52 | 31 | 40 | 30 | 56 |
| Air Pressure at 17 (psi) | 35 | 45 | 55 | 55 | 55 | 55 | 55 | 35 |
| Air Temperature at 17 (°C.) | 300 | 300 | 300 | 300 | 300 | 330 | 330 | 340 |
| Die Temperature 16 (°C.) | 280 | 280 | 280 | 280 | 280 | 320 | 315 | 310 |
| Fiber Size 18 (Micrometer) | 4 | 4 | 4 | 2 | 2 | 2 | 2 | 4 |
| Weight Ratio Superabsorbent to Thermoplastic Fiber | 1:3 | 1:4 | 1:5 | 1:5 | 1:3 | 1:5 | 1:3 | 1:3 |

*PP is polypropylene of MFR 300, PET is polyethylene terephthalate of intrinsic viscosity 0.65, N-66 is Nylon 66 of intrinsic viscosity 0.8. The speed of screen 20 was adjusted to produce a web of 200 gram/$m^2$ basis weight. The drying chamber 23 was kept at 130° C.

Average fiber diameters were measured with a graded microscope. The superabsorbent and thermoplastic fibers are easily distinguishable since the superabsorbent fibers readily absorb and stain with water-soluble ink, while thermoplastic fibers do not.

EXAMPLE 9

Example 1 was repeated except that the pump feeding the benzoyl peroxide emulsion to the polyacrylic acid solution was shut off. Fibers formed in the same manner as in example 1, but the resultant web was not superabsorbent, upon wetting, the superabsorbent fiber dissolved and leaked out of the polypropylene melt-blown web; cross-linking of polyacrylic acid is achieved by a mechanism described in U.S. Pat. No. 3,379,564.

EXAMPLE 10

The fabrics produced in Examples 1-9 were tested, for absorbency, along with a control fabric (Example 1, without any superabsorbent fibers blended in), in the following manner:

Samples of fabrics were immersed in tap water of 20° C. for 5 and 20 minutes, respectively, then laid on a cellulose paper towel for 30 seconds. The amounts of water absorbed are listed in TABLE II.

TABLE II

| Sample No. | Basis Weight of sheet (gram/$m^2$) | Weight-percent absorbent fiber | Weight ratio of water sorbed after immersion to weight of sheet product: After 5 min. | After 20 min. |
|---|---|---|---|---|
| 1 | 202 | 25 | 71 | 73 |
| 2 | 203 | 20 | 58 | 61 |
| 3 | 199 | 17 | 50 | 52 |
| 4 | 198 | 17 | 75 | 78 |
| 5 | 200 | 25 | 85 | 91 |
| 6 | 203 | 17 | 72 | 80 |
| 7 | 198 | 20 | 83 | 87 |
| 8 | 201 | 20 | 84 | 88 |
| 9 | 204 | 25 | disintegrated | |
| 10 | 150 | — | 7 | 8 |

It is evident from TABLE II that the fabrics absorbed water approximately proportional to the superabsorbent content, the samples having finer fibers absorbed more water (compare sample 3 with 4). There was not noticeable difference between the webs having polypropylene, polyester or nylon fibers as the thermoplastic component. The webs could be handled without superabsorbent material dusting out.

While the invention has been described in connection with as exemplary embodiment thereof, it will be understood than many modifications will be apparent to those of ordinary skill in the art; and that this application is intended to cover any adaptations of variations thereof. Therefore, it is manifestly intended that this invention be only limited by the claims and the equivalents thereof.

What is claimed is:

1. The sorbent sheet product comprising a mixture of entangled melt-blown fibers and high-sorbency, water-insoluble fibers uniformly dispersed within each other, said sorbent fibers being selected from acrylic polymers having hydrophilic functionality.

2. The sorbent sheet product as defined in claim 1 wherein said melt-blown fibers are selected from polypropylene, polyethylene, polyester and polyamides.

3. The sorbent sheet product as defined in claim 1 wherein the sorbent fibers comprise at least 10 percent by weight of said sheet.

4. The sorbent sheet product as defined in claim 2 wherein the sorbent fibers comprise at least 10 percent by weight of said sheet.

5. The sorbent sheet product as defined in claim 1 wherein the diameter of the fibers is less than 15 micrometers in average.

6. The sorbent sheet product as defined in claim 2 wherein the diameter of the fibers is less than 15 micrometers in average.

7. The sorbent sheet product as defined in claim 3 wherein the diameter of the fibers is less than 15 micrometers in average.

8. The sorbent sheet product as defined in claim 1 wherein said water-insoluble fibers are essentially continuous in length.

9. The sorbent sheet product as defined in claim 1 wherein said melt-blown fibers are essentially continuous in length.

10. The sorbent sheet product as defined in claim 1 wherein said melt-blown fibers and said water-insoluble fibers are essentially continuous in length.

* * * * *